US009217406B2

(12) United States Patent
Jung et al.

(10) Patent No.: US 9,217,406 B2
(45) Date of Patent: Dec. 22, 2015

(54) METHOD FOR CONTROLLING A HIGH-PRESSURE FUEL PUMP

(75) Inventors: Uwe Jung, Wörth a. d. Donau (DE); Janos Radeczky, Wenzenbach (DE); Michael Wirkowski, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 335 days.

(21) Appl. No.: 13/000,731

(22) PCT Filed: Jul. 7, 2009

(86) PCT No.: PCT/EP2009/058605

§ 371 (c)(1), (2), (4) Date: Dec. 22, 2010

(87) PCT Pub. No.: WO2010/012571

PCT Pub. Date: Feb. 4, 2010

(65) Prior Publication Data

US 2011/0116938 A1 May 19, 2011

(30) Foreign Application Priority Data

Aug. 1, 2008 (DE) ..... 10 2008 036 120

(51) Int. Cl.
*F02M 59/36* (2006.01)
*F02D 41/06* (2006.01)
(Continued)

(52) U.S. Cl.
CPC ..... *F02M 59/366* (2013.01); *F02D 41/062* (2013.01); *F02D 41/3845* (2013.01); *F02D 2200/0602* (2013.01); *F02D 2250/31* (2013.01); *F02M 63/0225* (2013.01)

(58) Field of Classification Search
CPC ..... F04B 9/042; F04B 7/0266; F04B 7/04; F02M 59/205; F02M 59/367; F02M 59/366
USPC ..... 417/53; 123/456, 446, 458, 501, 502
See application file for complete search history.

(56) References Cited

U.S. PATENT DOCUMENTS 6,016,790 A * 1/2000 Makino et al. ..... 123/496
6,116,870 A * 9/2000 Kraemer ..... 417/490
(Continued)

FOREIGN PATENT DOCUMENTS

DE 4321127 A1 1/1995 ..... F02D 41/20
DE 10162989 10/2003 ..... F02D 41/38
(Continued)

OTHER PUBLICATIONS

Chinese Office Action, Chinese Patent Application No. 200980124368.6, 17 pages, May 29, 2012.
(Continued)

*Primary Examiner* — Alexander Comley
(74) *Attorney, Agent, or Firm* — Slayden Grubert Beard PLLC

(57) ABSTRACT

An electrically controllable electromechanical inlet valve (2*a*) which is closed in the currentless state and is held in the closed state by the force of a spring (2*b*), an outlet valve (5*a*), and a displacement element (6), the inlet valve is operated in a self-controlling operating mode after a start command is present. In the self-controlling operating mode, the rail pressure is built without knowledge of the phase position of the displacement element. During the self-controlling operating mode, the phase position of the displacement element is determined. After the phase position of the piston or displacement element is determined, the inlet valve is switched over to a non-self-controlling operating mode.

20 Claims, 3 Drawing Sheets

(51) Int. Cl.
*F02D 41/38* (2006.01)
*F02M 63/02* (2006.01)

(56) References Cited

U.S. PATENT DOCUMENTS

| | | | | |
|---|---|---|---|---|
| 6,659,085 | B2 * | 12/2003 | Kojima | 123/456 |
| 6,694,952 | B1 * | 2/2004 | Yamazaki et al. | 123/496 |
| 6,725,837 | B2 * | 4/2004 | Hiraku et al. | 123/436 |
| 6,886,536 | B2 * | 5/2005 | Ranaldo et al. | 123/456 |
| 7,198,034 | B2 * | 4/2007 | Ausiello et al. | 123/506 |
| 7,325,537 | B2 * | 2/2008 | Mueller et al. | 123/506 |
| 7,438,051 | B2 * | 10/2008 | Wachtendorf et al. | 123/446 |
| 7,591,239 | B2 * | 9/2009 | Okamoto | 123/179.17 |
| 7,637,252 | B2 * | 12/2009 | Jung et al. | 123/447 |
| 2002/0040704 | A1 * | 4/2002 | Onishi et al. | 123/446 |
| 2002/0174855 | A1 * | 11/2002 | Djordjevic | 123/458 |
| 2004/0000289 | A1 * | 1/2004 | Seo et al. | 123/447 |
| 2004/0168674 | A1 * | 9/2004 | Djordjevic | 123/456 |
| 2004/0200456 | A1 * | 10/2004 | Eser et al. | 123/458 |
| 2005/0045158 | A1 * | 3/2005 | Takahashi | 123/506 |
| 2005/0211224 | A1 * | 9/2005 | Inaguma et al. | 123/458 |
| 2006/0169250 | A1 * | 8/2006 | Mueller et al. | 123/446 |
| 2007/0295310 | A1 * | 12/2007 | Achleitner et al. | 123/495 |
| 2008/0314364 | A1 * | 12/2008 | Okamoto | 123/458 |
| 2009/0139489 | A1 * | 6/2009 | Serra et al. | 123/456 |

FOREIGN PATENT DOCUMENTS

| | | | | |
|---|---|---|---|---|
| DE | 10360332 | | 7/2005 | F02D 41/38 |
| DE | 102004056665 | A1 | 6/2006 | F02D 1/02 |
| DE | 102004062613 | | 7/2006 | F02D 41/38 |
| DE | 102005043684 | | 3/2007 | F02D 45/00 |
| DE | 102006023470 | A1 | 11/2007 | F02M 37/00 |
| DE | 102006026928 | A1 | 12/2007 | F02D 1/16 |
| EP | 1249599 | | 10/2002 | F02M 59/36 |
| EP | 1249599 | A2 | 10/2002 | F02M 59/36 |
| EP | 1541838 | | 6/2005 | F02D 41/06 |
| FR | 2878291 | | 5/2006 | F02M 59/36 |
| JP | 2002309988 | A | 10/2002 | F02D 41/06 |
| JP | 2005180420 | A | 7/2005 | F02M 47/00 |
| JP | 2006144802 | A | 6/2006 | F02M 51/00 |

OTHER PUBLICATIONS

German Office Action, German Patent application No. 102008036120.8-13, 4 pages, Jul. 1, 2009.

International Search Report and Written Opinion for Application No. PCT/EP2009/058605 (15 pages), Sep. 18, 2009.

International Search Report and Written Opinion for Application No. PCT/EP2009/057498 (13 pages), Sep. 23, 2009.

Korean Office Action, Korean Patent Application No. 10-2010-7029425, 17 pages, Jun. 20, 2012.

* cited by examiner

METHOD FOR CONTROLLING A HIGH-PRESSURE FUEL PUMP

CROSS-REFERENCE TO RELATED APPLICATIONS

This application is a U.S. National Stage Application of International Application No. PCT/EP2009/058605 filed Jul. 7, 2009, which designates the United States of America, and claims priority to German Application No. 10 2008 036 120.8 filed Aug. 1, 2008, the contents of which are hereby incorporated by reference in their entirety.

TECHNICAL FIELD

The invention relates to a method for controlling a high-pressure fuel pump, as may be used, for example, in connection with common-rail injection systems.

BACKGROUND

Common-rail injection systems are already known. In this case, said systems are injection systems for internal combustion engines, in which a high-pressure pump brings the fuel to a high pressure level. The pressurized fuel fills a pipe system which is continuously under pressure during operation of the engine.

Such a common-rail injection system is disclosed in DE 10 2006 023 470 A1. The system disclosed therein has a high-pressure fuel pump for delivering fuel, a high-pressure fuel accumulator connected to the high-pressure fuel pump for storing fuel at an injection pressure relative to the environment of the common-rail injection system, at least one injector connected to the high-pressure fuel accumulator for delivering fuel into at least one combustion chamber, a return line for returning fuel from the injector to the high-pressure fuel pump at a return line pressure relative to the environment of the common-rail injection system and an adjusting means for adjusting the return line pressure.

A further common-rail injection system is disclosed in DE 10 2006 026 928 A1. The system disclosed therein contains a fuel tank, a high-pressure fuel pump, a rail line, a pressure accumulator, an injector and a digital controller. In the supply line between the fuel tank and the high-pressure fuel pump, a volume flow control valve is arranged which is controlled by the digital controller via a volume control valve control line. The high-pressure fuel pump has at least one displacement unit. During operation of the injection system, it provides an injection pressure applied to the injector in the rail line.

Phase-gating controlled pumps provided with electrically actuated inlet valves also belong to the prior art, in which the inlet valve is opened in the currentless state.

Moreover, phase-gating controlled pumps provided with electrically actuated inlet valves are already known in which the inlet valve is closed in the currentless state. In this case, the inlet valve is kept closed by a spring. Without electrical control, such pumps are self-controlling due to the spring layout and the pressure ratios upstream and downstream of the inlet valve. Such a pump is not well suited to be a high-pressure pump as, in the case of a control malfunction which, for example, may be caused by a plug connector becoming detached, the aforementioned self control undesirably leads to full delivery of the pump. In such pumps, it is already known to use an overpressure valve in order to prevent the hydraulic system from rupturing due to the aforementioned full delivery of the pump.

In phase-gating controlled pumps provided with electrically actuated inlet valves, in which the valve is closed in the absence of current and the spring force is greater than the force resulting from the pressure difference (pressure upstream and downstream of the valve) the pump may not pump without electrical control of the inlet valve. This has the result that after the start-up of the internal combustion engine, i.e. after a start signal is present, initially the phase position of the plunger of the pump has to be identified in order to be able to synchronize the electrical control of the inlet valve with the rotation of the crankshaft. This, in turn, has the result that the pressure build-up and thus also the engine start-up are delayed.

SUMMARY

According to various embodiments, the drawbacks described above can be eliminated.

According to an embodiment, in a method for controlling a high-pressure fuel pump which comprises an electrically controllable electromechanical inlet valve which is closed in the currentless state and is held in the closed state by the force of a spring, an outlet valve and a displacement element, —the inlet valve is operated in a self-controlling operating mode after a start command is present,—during the self-controlling operating mode, the phase position of the displacement element is determined, and—after the phase position of the displacement element is determined, the inlet valve is switched over to a non-self-controlling operating mode.

According to a further embodiment, in the self-controlling operating mode the inlet valve can be controlled depending on the pressure difference between the pressure prevailing in a low-pressure channel and the pressure prevailing in a pressurization chamber of the high-pressure fuel pump. According to a further embodiment, the pressure difference can be produced by a movement of the displacement element or by the pressure produced by a prefeed pump. According to a further embodiment, in the self-controlling operating mode, the inlet valve can be controlled by means of a force acting on an actuator, such that the spring force holding the inlet valve in the closed state is compensated. According to a further embodiment, the inlet valve in the self-controlling operating mode can be controlled irrespective of the phase position of the displacement element. According to a further embodiment, the phase position can be determined by an evaluation of the pressure characteristic in the rail which is present during the movement of the displacement element. According to a further embodiment, within the context of the evaluation of the pressure characteristic, a transition of the pressure characteristic curve from a rising characteristic to a flat characteristic can be detected. According to a further embodiment, within the context of the evaluation of the pressure characteristic, a transition of the pressure characteristic curve from a flat characteristic to a rising characteristic can be detected. According to a further embodiment, in the self-controlling operating mode the inlet valve can be closed when a pressure sensor in the rail detects a pressure value exceeding a predetermined maximum pressure. According to a further embodiment, in the non-self-controlling operating mode the inlet valve can be controlled depending on the phase position of the displacement element.

BRIEF DESCRIPTION OF THE DRAWINGS

Further features and advantages are revealed from the explanation thereof by way of example with reference to the figures, in which.

DETAILED DESCRIPTION

Figure 1:
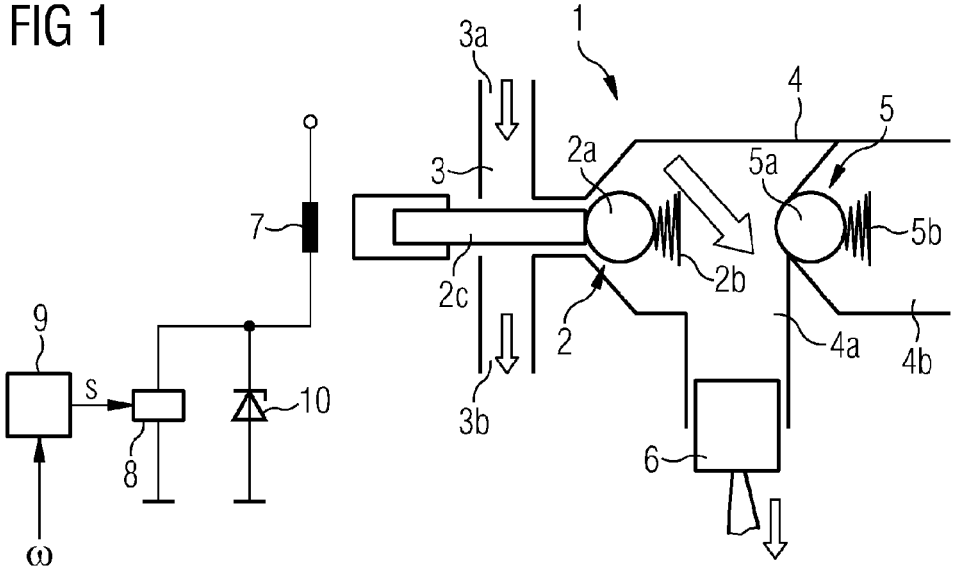
FIG. 1 shows a first sketch for explaining a device for implementing the method according to various embodiments.

According to various embodiments, in a method for controlling a high-pressure fuel pump, which comprises an electrically controllable electromechanical inlet valve which is closed in the currentless state and is held in the closed state by the force of a spring, an outlet valve and a displacement element, the inlet valve is initially operated in a self-controlling operating mode, after a start command is present, during which the phase position of the displacement element is determined and after the phase position of the displacement element is determined, the inlet valve is switched over to a non-self-controlling operating mode.

In the self-controlling operating mode, the inlet valve is controlled depending on the pressure difference between the pressure prevailing in a low-pressure channel and the pressure prevailing in a pressurization chamber of the high-pressure fuel pump. This pressure difference is advantageously produced by a movement of the displacement element or by the pressure produced by a prefeed pump.

In order to bring the inlet valve into the self-controlling operating mode, after a start-up command is present, the inlet valve is controlled by means of a force acting on an actuator such that the spring force holding the inlet valve in the closed state is compensated. This has the result that comparatively low-pressure differences are already sufficient in order to bring the inlet valve from the closed state into the open state and vice versa.

During this operation of the inlet valve in the self-controlling operating mode, the phase position of the displacement element, which is still unknown, is detected at the time of the input of the start command. This preferably takes place by an evaluation of the pressure characteristic present during the movement of the displacement element in the pressurization chamber of the high-pressure fuel pump. Thus, transitions of the pressure characteristic curve from a rising characteristic to a flat characteristic and from a flat characteristic to a rising characteristic are advantageously detected.

Advantageously, by means of a pressure sensor in the high-pressure region of the system (for example, the rail) it is verified whether the pressure present there exceeds a predetermined maximum pressure. If this is the case, then the inlet valve is closed.

In the non-self-controlling operating mode, the inlet valve is controlled electrically depending on the phase position of the displacement element. Preferably, therefore, the inlet valve is opened when the displacement element is moved downwards. If the displacement element is moved upwards, then the inlet valve is preferably closed and the outlet valve opened.

By means of the method according to various embodiments, it is advantageously achieved that the high-pressure fuel pump delivers fuel as soon as the crankshaft rotates due to an actuation of the starter. An identification of the crankshaft angle which is carried out at this time, i.e. the pump phase, is not necessary. Thus full delivery is promoted and, as a result, a build-up of pressure which is as rapid as possible is enabled. This also applies in the case of non-identification of the pump phase as in this case, when a pressure threshold which may be established is exceeded, the inlet valve may be controlled so that a delivery of fuel is prevented. If the pump phase is identified, then the inlet valve is switched to a non-self-controlling operation, in which the inlet valve is controlled purely electrically, and in which the inlet valve in the event of faulty electrical control is kept in the closed state by the force of a spring, i.e. may not be opened by pressure differences between the pressure in the low-pressure channel and the pressure in the pressurization chamber. Such an arrangement of the spring force is advantageous as, in the case of a control failure due to a malfunction, the system is prevented from rupturing at high rotational speed, and/or as a possible additional overpressure valve is dispensed with.

The method according to various embodiments is, in particular, also advantageous if the high-pressure fuel pump is fitted at a transmission ratio to the crankshaft which is not equal to 1:1. In this case, it would lead to an even greater delay in the pressure build-up, as in this case for identifying the pump phase position the rail pressure behavior would have to be measured and analyzed, but it would only result in a pressure build-up if the inlet valve were able to be controlled in a meaningful manner, i.e. with an appropriate pump phase position.

In systems in which the high-pressure fuel pump is fitted at a 1:1 ratio to the crankshaft, but not phased, with the first start-up at the end of the production line, a detection of the pump phase is possible by the self-suction mode, by analysis of the rail pressure build-up. In this case a saddle point of the pressure build-up characteristic curve i.e. a transition between a rising characteristic and a flat characteristic of the pressure characteristic curve, is equal to the upper dead center point of the pump piston motion. The determined phase position is stored and, with each further start-up, called up as an adaptive value.

In systems in which the high-pressure fuel pump is fitted at a ratio to the crankshaft which is not equal to 1:1, the pump phase position has to be identified with each new start-up. It may be undertaken in the initial self-suction mode, i.e. in the initial self-controlling operating mode.

FIG. 1 shows a first sketch for explaining a device for implementing the method according to various embodiments.

The device shown has a control unit 9. Said control unit provides at its outlet a control signal s, which is provided for controlling a switch 8. As an input signal, depending on which the control unit 9 determines the control signal s, the control unit 9 receives information about the crankshaft angle ω of the pump crankshaft. The switch 8 is preferably produced in the form of a field effect transistor. A terminal of the switch 8 is connected to earth. The terminal of the switch 8 remote from earth is connected to an actuator coil 7. The terminal of the switch 8 remote from earth is also connected to earth via a zener diode 10.

Moreover, the device shown has a high-pressure fuel pump 1. Said high-pressure fuel pump is provided with an inlet valve 2, a low-pressure channel 3, a cylinder 4, an outlet valve 5 and a displacement element 6. The displacement element 6 is preferably a plunger.

The inlet valve 2 is an electromechanical valve to which a closure element 2*a*, a spring 2*b* and an actuator 2*c* belong. The actuator 2*c* cooperates with the actuator coil 7, and is forced to the right in FIG. 1 when current flows through the actuator coil 7, so that the inlet valve 2 is opened. If no current flows through the actuator coil 7, then the inlet valve 2 is in the closed state. The characteristic curve of the spring 2*b* and/or the spring pretensioning thereof is selected so that in the absence of a flow of current through the actuator coil 7, the inlet valve is kept in the closed state and namely irrespective of the pressure ratios in the low-pressure channel 3 and the pressurization chamber 4*a* of the high-pressure fuel pump 1. The inlet 3*a* of the low-pressure channel 3 is connected to a fuel tank, not shown, from which fuel is supplied to the high-pressure fuel pump via a prefeed pump. The outlet 3*b* of the low-pressure channel 3 is, for example, connected to a pressure limit valve.

The cylinder 4 has the pressurization chamber 4*a* and a high-pressure chamber 4*b*. The outlet valve 5 is arranged between the pressurization chamber 4*a* and the high-pressure chamber 4*b*, so that when the outlet valve 5 is opened, fuel is conveyed from the pressurization chamber 4*a* into the high-pressure chamber 4*b*. The plunger 6 is movably mounted within the pressurization chamber 4*a*. By a movement of the plunger 6 downwards, the pressure in the pressurization chamber 4*a* is reduced. With a movement of the plunger 6 upwards, i.e. in the delivery direction, the pressure in the pressurization chamber 4*a* is increased. The plunger 6 cooperates in the known manner with the pump crankshaft. The current position of the plunger 6, i.e. the phase position thereof, is described by the crankshaft angle ω. Information about the current crankshaft angle is supplied to the control unit 9 as an input signal.

The outlet valve 5 is a mechanical valve which has a closure element 5*a* and a spring 5*b*. This valve is opened when the pressure in the pressurization chamber 4*a* of the cylinder 4 is greater than the sum of the closing force of the outlet valve 5 produced by the spring 5*b* and the force which is caused by the pressure prevailing in the high-pressure chamber 4*b*, and closed again when the pressure in the pressurization chamber 4*a* is again less than the stated sum.

In FIG. 1, the inlet valve 2 is shown in the open state, said open state of the control unit 9 having been initiated by the emission of the control signal s. In this open state—as indicated by the arrow shown in the pressurization chamber 4*a*—fuel is conveyed from the low-pressure channel 3 into the pressurization chamber 4*a*. The plunger 6 thus moves downwards—as is indicated by the arrow below the plunger 6—so that the pressure in the pressurization chamber 4*a* is reduced and fuel is drawn out of the low-pressure channel into the pressurization chamber 4*a*.

If the plunger 6 has reached its lower dead center point, then this is signaled to the control unit 9, which then stops the emission of the control signal s. This has the result that the switch 8 is moved into its closed state, so that the flow of current through the actuator coil 7 is also stopped. This in turn has the effect that the actuator 3 which, for example, is a solenoid, is moved to the left, so that the inlet valve 2 is moved into its closed state.

By the wiring of the terminal of the switch 8 remote from earth to the zener diode 10, it is advantageously achieved that the actuator 2*c* when switching over from the state of the actuator coil where it is "supplied with current" to the state of the actuator coil where it is "not supplied with current", is subjected to a reverse voltage potential by the avalanche voltage of the zener diode 10. This has the result that the magnetic field breaks down more rapidly.

Figure 2:
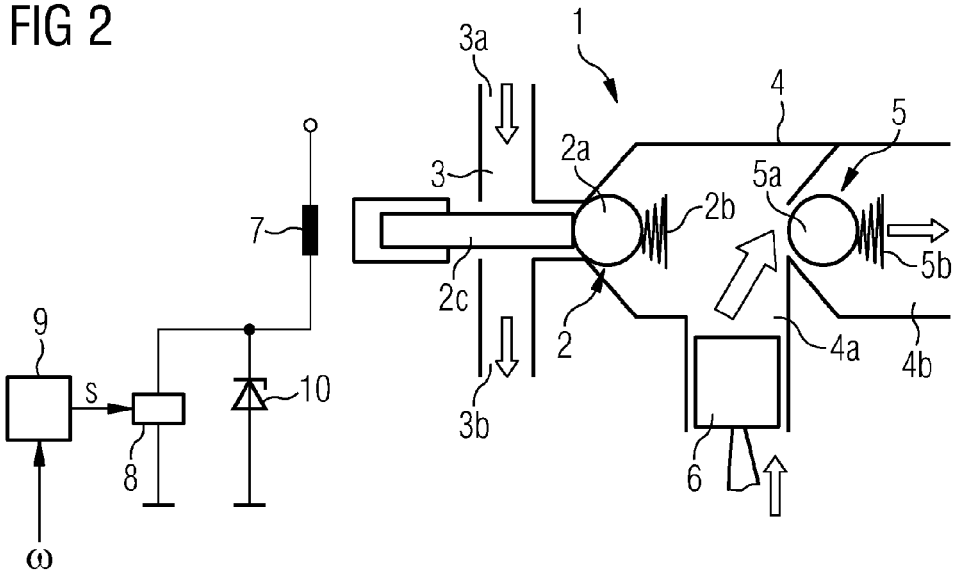
FIG. 2 shows a second sketch for explaining a device for implementing the method according to various embodiments.

FIG. 2 shows a second sketch for explaining a device according to various embodiments.

The device shown differs from the device shown in FIG. 1, in that the inlet valve 2 is in the closed state and the outlet valve 5 is in the open state. Moreover, the plunger 6 is in its upward movement, i.e. in the delivery direction. This is illustrated in FIG. 2 by the arrow below the plunger 6. By the plunger 6 moving upwards, the pressure in the pressurization chamber 4*a* is increased. If this pressure is greater than the sum of the closing force produced by the spring 5*b* and the force which is produced by the pressure prevailing in the high-pressure chamber 4*b*, then the outlet valve 5 is opened and fuel is forced out of the pressurization chamber 4*a* into the high-pressure chamber 4*b* of the cylinder 4, as illustrated by the arrow in the pressurization chamber 4*a*.

The device described with reference to FIGS. 1 and 2 has the advantage that the inlet valve is not opened and closed in the sense of self control as a result of the pressure ratios in the low-pressure channel 3 and the pressurization chamber 4*a*, but exclusively by electrical control which originates from the control unit 9. The control unit 9 opens and closes the inlet valve 2 depending on the current position of the plunger 6, i.e. depending on the pump crankshaft angle. It is able to control the quantity of fuel delivered, depending on the conditions respectively present, limited by the maximum possible quantity delivered and the aforementioned pump crankshaft angle. In particular, it may alter the start of the delivery and the end of the delivery by appropriate control of the switch 8 and, as a result, control the quantity of fuel delivered and the pressure in the system, depending on the conditions respectively present.

Generally, the termination of the suction of fuel from the low-pressure channel 3 into pressurization chamber 4 is brought about by closing the inlet valve 2. If then the pressure prevailing in the pressurization chamber is increased to such an extent that it is greater than the sum of the closing force caused by the spring 5*b* and the force which is caused by the pressure prevailing in the high-pressure chamber 4*b*, then the outlet valve 5 is opened, in order to force fuel out of the pressurization chamber 4*a* into the high-pressure chamber 4*b*.

In order to be able to undertake the electrical control of the inlet valve, after a start command is present, initially a detection of the phase position of the plunger 6 is required, i.e. a detection of the crankshaft angle ω, in order to be able to undertake the above-described electrical control in a suitable phase position of the plunger.

According to various embodiments, in order to prevent the time delay of the pressure build-up and thus of the engine start-up, caused by this detection of the crankshaft angle, after a start command is present, the inlet valve is initially operated in a self-controlling operating mode for a sufficient length of time until the crankshaft angle ω, i.e. the phase position of the plunger 6, is determined. Only then is the inlet valve switched over to a non-self-controlling operating mode, in which the inlet valve as has been described above is controlled exclusively electrically and depending on the crankshaft angle.

Figure 3:
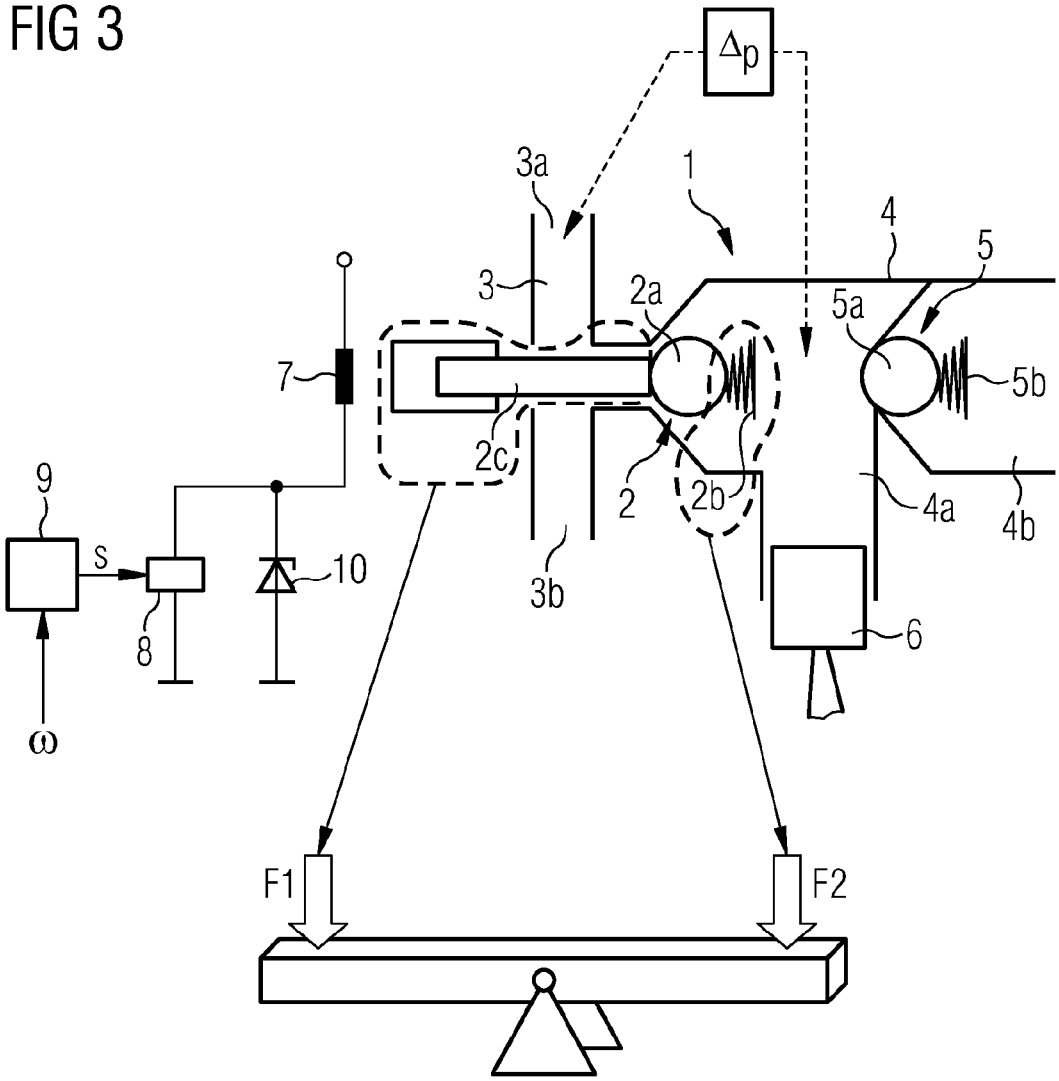
FIG. 3 shows a third sketch for explaining a device for implementing the method according to various embodiments and FIG. 4 shows diagrams for explaining the detection of the phase position of the plunger.

In order to be able to carry out the self-controlling operating mode after a start command is present, the inlet valve is electrically controlled so that the force by means of which the actuator 2*c* of the inlet valve 2 operates against the force of the spring 2*b* holding the inlet valve 2 closed, compensates for the force of the spring. This is illustrated in FIG. 3 in which the force of the actuator is denoted by F1 and the force of the spring by F2.

The above-described electrical control has the result that, after a start command is present, the inlet valve 2 is opened and closed depending on the pressure difference Δp between the pressure prevailing in the low-pressure channel 3 and the pressure prevailing in the pressurization chamber 4*a*. If the pressure in the low-pressure channel 3 is greater than the pressure in the pressurization chamber 4*a*, then the inlet valve 2 is opened by this pressure difference. This aforementioned pressure difference Δp may be brought about by the fuel being forced out of the fuel tank, not shown, into the low-pressure channel at a higher pressure, as a result of a prefeed pump, also not shown. The aforementioned pressure difference Δp may also be brought about by the plunger 6 moving downwards in the pressurization chamber 4*a*, as is illustrated by the arrow illustrated in FIG. 1 below the plunger 6.

If the pressure in the pressurization chamber 4*a* is greater than the pressure in the low-pressure channel 3, then the inlet valve 2 is closed.

Consequently, after a start command is present, initially the inlet valve is operated in a self-controlling operating mode. During this self-controlling operating mode the phase position of the plunger 6 is determined. Once this determination of the phase position of the plunger 6 is concluded, then the inlet valve is switched over to a non-self-controlling operating mode in which the inlet valve is controlled exclusively electrically and depending on the phase position of the plunger.

Figure 4:
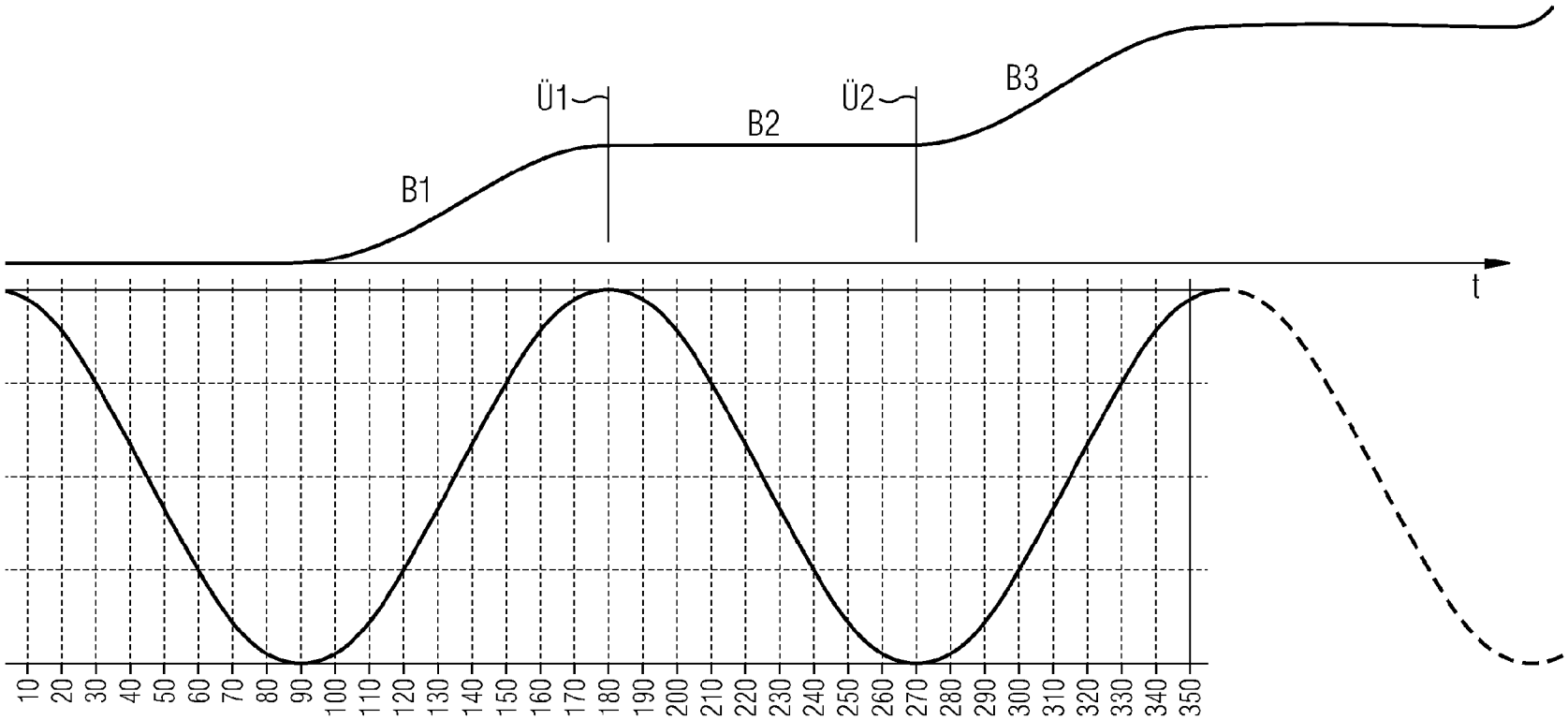

FIG. 4 shows diagrams for explaining the detection of the phase position of the plunger 6, as is initially carried out after the input of a start command. In the upper diagram, the pressure p building up in the pressurization chamber 4*a* is illustrated along the ordinate and the time t is illustrated along the abscissa and in the lower diagram the movement of the plunger 6 depending on the piston angle is illustrated. From the upper diagram it may be seen that the pressure characteristic curve measured by means of a pressure sensor, not shown, initially has a linear rising region B1, then a transition Ü1 from the linear rising region B1 into a flat region B2 and then again a transition Ü2 from the flat region B2 into a linear rising region B3. The upper dead center point of the plunger motion is located in the region of the transition Ü1. The lower dead center point of the plunger motion is located in the region of the transition Ü2. By this measurement of the pressure characteristic curve and the identification of the transitions Ü1 and Ü2, the phase position of the plunger 6 and thus of the crankshaft angle ω may be detected.

What is claimed is:

1. A method for controlling a high-pressure fuel pump which comprises an electrically controllable electromechanical inlet valve, an outlet valve and a displacement element, the method comprising:

operating the inlet valve in alternating manner between a self-controlling operating mode and an electromechanically-controlled operating mode, including:

operating the inlet valve in the self-controlling operating mode after a start command is present, wherein in the self-controlling operating mode the inlet valve is subjected to (a) a pressure difference upstream and downstream of said inlet valve, (b) a spring force acting on the inlet valve in a closing direction, (c) an electromechanical force that opposes and compensates the spring force such that an opening and closing of the inlet valve is controlled by the pressure difference upstream and downstream of said inlet valve, during operation of the inlet valve in the self-controlling operating mode, determining a phase position of the displacement element, and after the phase position of the displacement element is determined, switching the inlet valve to the electromechanically-controlled operating mode wherein the inlet valve is opened and closed electromechanically depending on the determined phase position, wherein in a currentless state of the inlet valve, the spring force acting on the inlet valve exceeds the pressure difference upstream and downstream of said inlet valve to thereby maintain the inlet valve in the closed position throughout the currentless state of the inlet valve.

2. The method according to claim 1, wherein in the self-controlling operating mode the inlet valve is controlled depending on a pressure difference between a pressure prevailing in a low-pressure channel and a pressure prevailing in a pressurization chamber of the high-pressure fuel pump.

3. The method according to claim 2, wherein the pressure difference is produced by a movement of the displacement element or by a pressure produced by a prefeed pump.

4. The method according to claim 1, wherein in the self-controlling operating mode, the inlet valve is controlled by means of a force acting on an actuator, such that the spring force holding the inlet valve in the closed state is compensated.

5. The method according to claim 1, wherein the inlet valve in the self-controlling operating mode is controlled irrespective of the phase position of the displacement element.

6. The method according to claim 1, wherein the phase position is determined by an evaluation of a pressure characteristic in a rail which is present during a movement of the displacement element.

7. The method according to claim 6, wherein within the context of the evaluation of the pressure characteristic, a transition of a pressure characteristic curve from a rising characteristic to a flat characteristic is detected.

8. The method according to claim 6, wherein within the context of the evaluation of the pressure characteristic, a transition of a pressure characteristic curve from a flat characteristic to a rising characteristic is detected.

9. The method according to claim 1, wherein in the self-controlling operating mode the inlet valve is closed when a pressure sensor in a rail detects a pressure valve exceeding a predetermined maximum pressure.

10. The method according to claim 1, wherein in the self-controlling the inlet valve is controlled depending on the phase position of the displacement element.

11. A system comprising:

a high-pressure fuel pump which comprises an electrically controllable electromechanical inlet valve, a spring configured to apply a spring force to the inlet valve, an outlet valve, and a displacement element, a control device controlling the high-pressure fuel pump and being operable to operate the inlet valve in alternating manner between a self-controlling operating mode and an electromechanically-controlled operating mode by:

operating the inlet valve in the self-controlling operating mode after a start command is present, wherein in the self-controlling operating mode the inlet valve is subjected to (a) a pressure difference upstream and downstream of said inlet valve, (b) a spring force acting on the inlet valve in a closing direction, (c) an electromechanical force that opposes and compensates the spring force such that an opening and closing of the inlet valve is controlled by the pressure difference upstream and downstream of said inlet valve, during operation of the inlet valve in the self-controlling operating mode, determining a phase position of the displacement element, and after the phase position of the displacement element is determined, switching the inlet valve to the electromechanically-controlled operating mode wherein the control device electromechanically opens and closes the inlet valve depending on the determined phase position, wherein in a currentless state of the inlet valve, the spring force acting on the inlet valve exceeds the pressure difference upstream and downstream of said inlet valve to thereby maintain the inlet valve in the closed position throughout the currentless state of the inlet valve.

12. The system according to claim 11, wherein in the self-controlling operating mode, the control device controls the inlet valve depending on a pressure difference between a pressure prevailing in a low-pressure channel and a pressure prevailing in a pressurization chamber of the high-pressure fuel pump.

13. The system according to claim 12, wherein the pressure difference is produced by a movement of the displacement element or by a pressure produced by a prefeed pump.

14. The system according to claim 11, wherein in the self-controlling operating mode, the inlet valve is controlled by means of a force acting on an actuator, such that the spring force holding the inlet valve in the closed state is compensated.

15. The system according to claim 11, wherein the inlet valve in the self-controlling operating mode is controlled irrespective of the phase position of the displacement element.

16. The system according to claim 11, wherein the phase position is determined by an evaluation of a pressure characteristic in a rail which is present during a movement of the displacement element.

17. The system according to claim 16, wherein within the context of the evaluation of the pressure characteristic, a transition of a pressure characteristic curve from a rising characteristic to a flat characteristic is detected.

18. The system according to claim 16, wherein within the context of the evaluation of the pressure characteristic, a transition of a pressure characteristic curve from a flat characteristic to a rising characteristic is detected.

19. The system according to claim 11, wherein in the self-controlling operating mode the inlet valve is closed when a pressure sensor in a rail detects a pressure valve exceeding a predetermined maximum pressure.

20. The system according to claim 11, wherein in the self-controlling operating mode the inlet valve is controlled depending on the phase position of the displacement element.

* * * * *